US005622366A

United States Patent [19]

Inoue

[11] Patent Number: 5,622,366

[45] Date of Patent: Apr. 22, 1997

[54] MEDAL PUSHER GAME MACHINE

[75] Inventor: Haruo Inoue, Tokyo, Japan

[73] Assignee: Eagle Co., Ltd., Tokyo, Japan

[21] Appl. No.: 667,786

[22] Filed: Jun. 21, 1996

[51] Int. Cl.[6] ..... A63F 7/00

[52] U.S. Cl. ..... 273/138.2

[58] Field of Search ..... 273/138.1, 138.2, 273/138 R, 138 A, 446–448, 459, 460, 440, 454, 441, 121 A

[56] References Cited

U.S. PATENT DOCUMENTS

| | | | |
|---|---|---|---|
| 4,375,286 | 3/1983 | Seitz et al. | 273/121 A |
| 5,275,402 | 1/1994 | Malavazos et al. | 273/138.2 |
| 5,553,865 | 9/1996 | Shoemaker, Jr. et al. | 273/448 |

*Primary Examiner*—Paul E. Shapiro
*Attorney, Agent, or Firm*—Young & Thompson

[57] ABSTRACT

A cylindrical medal pusher is eccentrically mounted on a rotary shaft. As the rotary shaft drives the medal pusher to eccentrically rotate it, a portion of the circumferential surface of the medal pusher remotest from the rotary shaft sequentially passes through play areas and pushes a medal on a play field toward the final edge of the play field so that the medal is moved to the area outside of a locus of the remotest portion. A medal thrown by player is pushed by the medal pusher to drop another medal placed on the play field from the final edge of the play field. The dropped medal is counted when it enters a drop hopper which pays out the same number of medals as the counted medals to the player. The partition plate protrudes above the play field and the front end facing the rotary shaft is always near at the circumferential surface of the medal pusher so that a medal is not permitted to transfer between different play areas. As the medal pusher rotates and the portion of the circumferential surface remotest from the rotary shaft passes through each play area, the front end of the partition plate is pushed by the circumferential surface and lower surface of the medal pusher. The partition plate is partially retracted under the play field to allow the eccentric rotation of the medal pusher.

11 Claims, 7 Drawing Sheets

MEDAL PUSHER GAME MACHINE

BACKGROUND OF THE INVENTION

1. Field of the Invention

The present invention relates to a game machine for playing a game with disk-shaped medals (including coins and tokens), and more particularly to a medal pusher game machine having a rotary medal pusher mounted on a horizontal play field for pushing a medal and dropping medals from the final edge of the play field wherein a player observes the rotation phase of the medal pusher and throws a medal at a proper timing to the play field.

2. Description of the Related Art

A medal pusher game machine has a plate-like medal pusher which linearly and reciprocally moves at a constant stroke on a horizontal play field on which a number of medals are placed. As the medal pusher retracts, a space is formed between the medal pusher and a medal pool field. A player throws a medal to this space by targeting the distal end of a spout medal shoot. If a medal is placed at a proper position in this space, the front pushing surface of the pusher moving forward next time pushes this medal toward the medal pool field. Even if one medal is entered, one or more medals fall down from the final edge of the play field, depending upon the state of the medal pool field. The fallen medals are paid to the player. Depending upon the state of the medal pool field, no medal may fall even if a medal is placed in the space, or medals in the pool field may not be pushed by the medal pusher moving forward if the medal is thrown to the pool field, and no medal is paid to the player.

In addition to a plate-like medal pusher linearly and reciprocally moving, a game machine using a rotary medal pusher is known in U. S. Pat. No. 5,275,402. In this game machine, a vertical shaft is mounted at the center of a play field and a cylindrical medal pusher rotates eccentrically about this shaft. As the medal pusher rotates, its circumferential surface moves on the player field. An area outside of a locus of a point on the circumferential surface of the medal pusher remotest from the center of the shaft forms a medal pool field, and a space is formed between the pool field and a locus of a point nearest to the center of the shaft. A player therefore throws a medal to this space while observing the rotation phase of the medal pusher. Since this space is formed uniformly around the shaft, two players can use this machine at the same time by dividing the play field into two opposing play areas, or the play field may be divided into three or four play areas to increase the number of play areas. Since the medal pusher surface is the circumferential surface of the cylindrical medal pusher, the direction of pushing a medal changes in various ways and a player is interested in this machine more than a conventional game machine.

In the game machine cited above, a trench for dropping a medal is formed at the boundary of the opposing two divided play areas. This trench prevents a medal entered by one player from entering the play area of the other player. If a medal enters from one play area to the other play area, this medal may change the state of the medal pool field of the other play area or collide with a medal entered by the other player, hindering a normal play. Therefore, if a plurality of play areas are to be formed on a game machine, it is necessary to partition each play area.

However, if a plurality of play areas are partitioned by trenches, entered medals may fall into trenches without contributing to any game, loosing interest on the game considerably. If three or more play areas are formed around the rotary type medal pusher and the boundaries are partitioned with trenches, entered medals become more easy to drop, and such a game machine is not suitable for practical use. Although partition plates may be mounted upright to partition play areas, the distal end of the partition plate cannot be entered inside of the medal pool field because the medal pusher rotates eccentrically at the central area of play areas. Therefore, the distal ends of the partition plates and the circumferential surface of the medal pusher cannot be made always in contact and the play areas cannot be partitioned completely.

3. Objects of the Invention

It is a principal object of the present invention to provide a medal pusher game machine capable of always and completely partitioning a plurality of play areas formed around a rotary type medal pusher.

It is another object of the present invention to provide a medal pusher game machine in which a plurality of play areas formed around a rotary type medal pusher are partitioned by vertical partition plates and the partition plates are adapted to move without forming any gap allowing a medal to pass therethrough, between the distal ends of the partition plates and the pusher surface of the medal pusher.

It is a further object of the present invention to provide a medal pusher game machine with a simple partition plate moving mechanism for moving the partition plates in association with the rotation of a medal pusher.

It is a still further object of the present invention to provide a medal pusher game machine wherein not only a game of dropping medals by the rotation of a medal pusher, but also an additional game is provided for increasing an interest of games, the additional game being given if a medal drops in a win hole formed at the play area, and medals are paid to the player if a hit is obtained in this additional game.

SUMMARY OF THE INVENTION

The above and other objects and advantages of the present invention can be achieved by a medal pusher game machine which comprises a horizontal play field on which medals are pooled. A medal pusher eccentrically rotates on the horizontal play field. A plurality of partition plates project above the play field for partitioning the play field into a plurality of play areas around the medal pusher. A partition plate moving mechanism allows the partition plates to move readily in a direction substantially vertical to the play field, to avoid hindering the rotation of the medal pusher. Since the medal pusher always rotates, the partition plates can be moved in association with the rotation of the medal pusher.

In a preferred embodiment of this invention, the medal pusher is cylindrical and has a circumferential surface substantially vertical to the play field. Four play areas are formed around the medal pusher, and four partition plates are used for partitioning the four play areas. The partition plate is mounted on the bottom side of a board constituting the play field at its top side and in swingable fashion. The upper edge of the partition plate protrudes above the play field, and the partition plate is biased by a spring so that one end of the partition plate is pushed toward the circumferential surface of the medal pusher. As the medal pusher rotates and the circumferential surface moves nearer to a vertical shaft, the partition plate projects above the play field, whereas as the circumferential surface moves away from the vertical shaft, the partition plate is pushed by the circumferential surface and the one end side thereof sinks under the play field. In this manner, since the one end side of the partition plate is always in contact with the circumferential surface of the medal pusher, the play areas can be always partitioned reliably.

In another preferred embodiment of this invention, a win hole is formed in each play area partitioned by the partition plates. When a medal entered by a player drops into this win hole, an additional game machine assembled with an operation panel starts operating. When a hit is gained during this additional game, a pay hopper in the game machine operates to pay out medals.

DETAILED DESCRIPTION OF THE INVENTION

Figure 1:
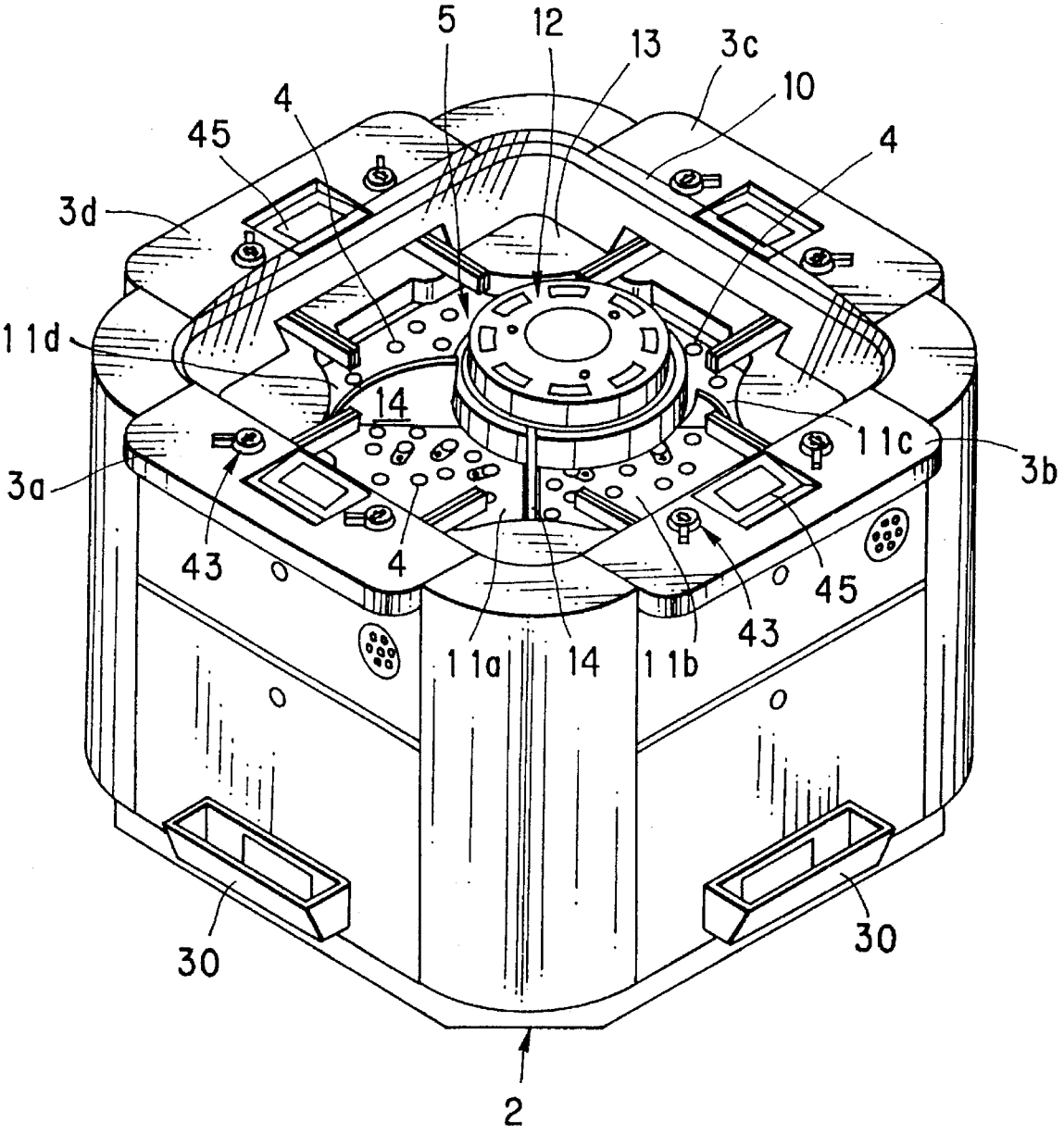
FIG. 1 is a perspective view of a medal pusher game machine embodying the present invention.

Referring to FIG. 1, the main body of a game machine 2 is generally of a square shape as viewed from an upper position and a horizontal play field 5 is formed therein. A number of medals 4 are placed in advance on the play field 5. Operation panels 3*a* to 3*d* are provided at each side of the square game machine 2. The play field 5 is divided into four play areas 11*a* to 11*d* in correspondence with the four operation panels 3*a* to 3*d*. Four players can play a game at the same time by using these play areas and operation panels. The top of the game machine 2 is covered with a transparent plastic cover 10 so that a player cannot touch the play field 5 with hands.

A medal pusher 12 generally cylindrical is mounted at the center of the play field 5. This medal pusher 12 rotates eccentrically, and its circumferential surface pushes medals 4 placed on the play field 5. At the four corners of the play field 5, steps 13 higher than the play field 5 are formed. A partition plate 14 is formed between the step 13 and the medal pusher 12. The partition plates 14 prevent medals 4 from moving from one play area to another play area.

Figure 2:
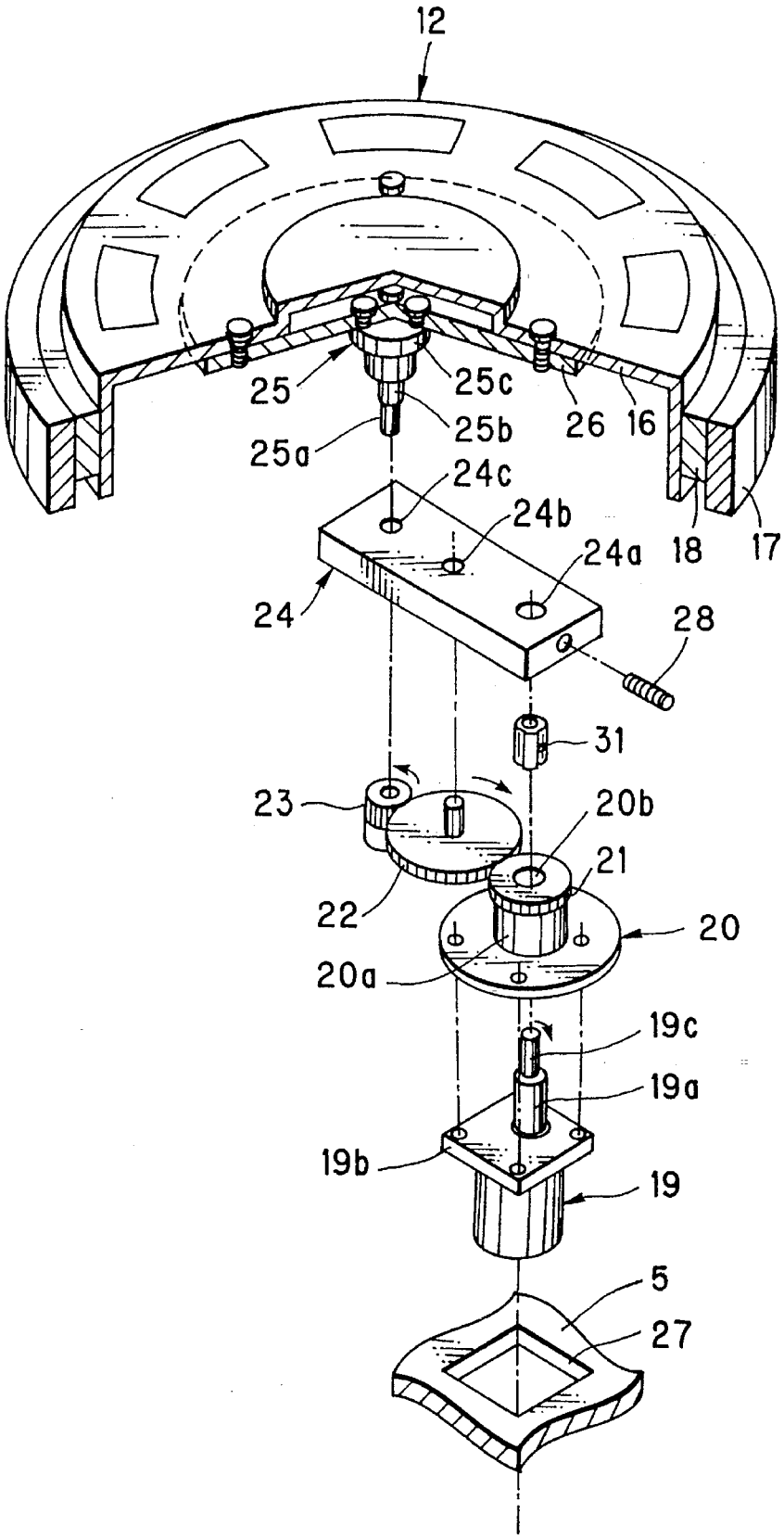
FIG. 2 is a broken perspective view showing the structure of the medal pusher game machine shown in FIG. 1.
Figure 3:
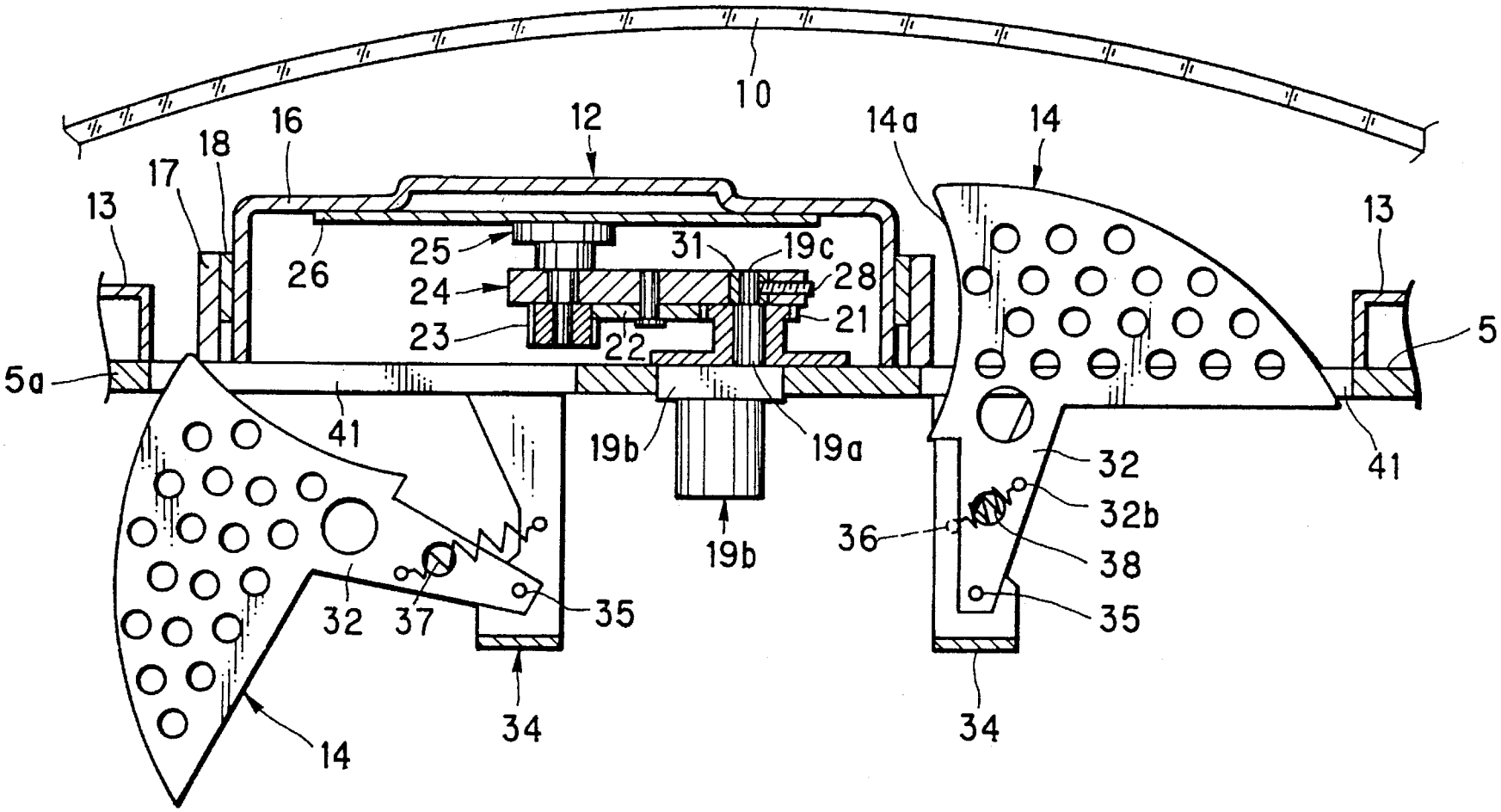
FIG. 3 is a cross sectional view showing the main parts of the medal pusher game machine shown in FIG. 1.

As shown in FIGS. 2 and 3, the medal pusher 12 is constituted by a design panel 16, a pusher ring 17, and a spacer ring 18. The design panel 16 is made of plastic material and molded in a saucer shape. The pusher ring 17 is mounted around the design panel 16 and is used for pushing medals 4 on the play field 5. The spacer ring 18 is disposed between the pusher ring 17 and the design panel 16. The medal pusher 12 is rotated eccentrically by an eccentric rotation mechanism assembled under the design panel 16. The circumferential surface of the pusher ring 17 is vertical to the play field 5, but may be inclined if desired.

The eccentric rotation mechanism is constituted by a motor 19, a motor support plate 20, gears 21, 22, and 23, a gear support plate 24, a rotation bearing shaft 25, and a pusher mount plate 26. The motor 19 has a rectangular mount plate 19*b* on the side where a rotary shaft 19*a* extends. This mount plate 19*b* is assembled with the motor support plate 20. A rectangular opening 27 is formed in and through a board 5*a* at the central area whose upper surface constitutes the play field 5. The motor 19 mounted on the motor mount plate 20 is fitted in this opening 27. The motor support plate 20 abuts on the play field 5, and the motor 19 is fixedly mounted, with its rotary shaft 19*a* being made upright. The mount plate 19*b* engages with the opening 17 so that the motor 19 can be fixed in the rotation direction.

An upward projecting cylinder 20*a* is formed at the center of the motor support plate 20. A gear 21 is fixed to the top of the cylinder 20*a*. A through hole 20*b* is formed in the cylinder 20*a* and gear 21. The rotary shaft 19*a* of the motor 19 is inserted into this through hole 20*b*. A smaller diameter portion 19*c* at the tip of the rotary shaft 19 is inserted into the through hole 20*b* and into a sleeve 31. This sleeve 31 is inserted into a hole 24*a* of the gear support plate 24, and a fixing screw 28 is threaded from the side of the gear support plate 24 into a hole of the sleeve 31 until it reaches the smaller diameter portion 19*c* of the motor 19*a*, so that the rotary shaft 19*a* and gear support plate 24 are coupled integrally. A gear 22 is rotatively mounted in a hole 24*b* of the gear support plate 24 from the lower side. A gear 23 engages with an engaging portion 25*a* of the rotation bearing shaft 25 via a hole 24*c* of the gear support plate 24.

The rotation bearing shaft 25 is constituted by the engaging portion 25*a* engaged with the hole of the gear 23, a rotation bearing portion 25*b* rotatively inserted into the hole 24*c* of the gear support plate 24, and a flange 25*c* fixed to the center of the pusher mount plate 26 by screws. The pusher mount plate 26 is circular and is concentrically fixed to the upper inner wall of the design panel 16 by screws.

As the rotary shaft 19a of the motor 19 rotates in the clockwise direction as viewed in FIG. 2, the gear support plate 24 rotates in the same direction. As the gear support plate 24 rotates, the gear 22 meshed with the gear 21 rotates around the gear 21, and at the same time rotates in the clockwise direction. Therefore, the gear 23 meshing with the gear 22 rotates in the counter-clockwise direction. The medal pusher 12 therefore rotates eccentrically in the clockwise direction around the rotary shaft 19*a* of the motor 19, i.e., around the vertical axis at the center of the play field, and rotates in the counter-clockwise direction around the rotation bearing shaft 25.

As the medal pusher 12 eccentrically rotates around the rotary shaft 19*a* at the center of the play field, the portion of the circumferential surface of the pusher ring 17 remotest from the rotary shaft 19*a* pushes medals 4 toward the final edge of the play field 5 while sequentially passing through the play areas 11*a* to 11*d*, so that medals 4 are pooled outside of a locus of this portion. Medals 4 pushed to a trench 29 formed at the final edge of the play field 5 at each play area drops into the trench 29. A space is formed between the medal pool area and the circumferential surface of the medal pusher 12 while a portion thereof nearest to the rotary shaft 19*a* passes each play area.

Figure 4:
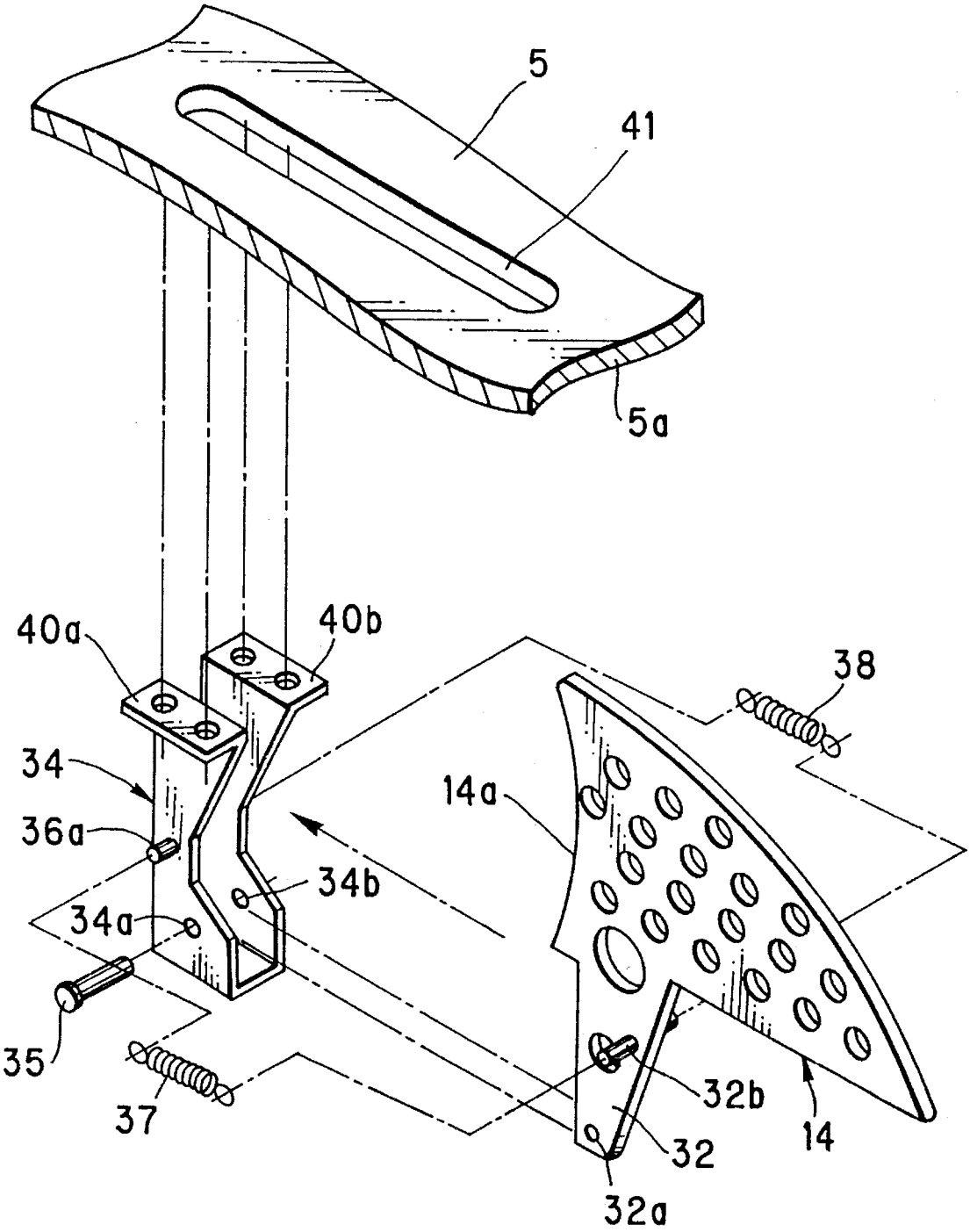
FIG. 4 is a broken perspective view showing the mount structure of the partition plate shown in FIG. 3.

As shown in FIGS. 3 and 4, the partition plate 14 is made of a plastic plate generally of a fan shape, and a mount piece 32 is integrally formed at the lower portion. A mount hole 32*a* is formed in the mount piece 32, and a pin 32*b* is fixedly mounted extending both the ends thereof from the front and back surfaces of the partition plate 14. At the front end facing the medal pusher 12, the partition plate 14 is formed with an abut side 14*a* gently curving inward. This abut side 14*a* is pushed by the circumferential surface of the pusher ring 17.

The partition plate 14 is assembled on a bracket 34 made of a metal thin plate bent in generally a U-character shape. The mount piece 32 of the partition plate 14 is inserted into the space in the bracket 34. Holes 34*a* and 34*b* formed in the bracket 34 at the lower portion are aligned with the mount hole 32*a* formed in the mount piece 32 and a mounting shaft 35 is inserted into these holes so that the partition plate 14 can be mounted pivotally on the bracket 34. A pin 36*a* is also fixedly mounted on the bracket 34 in the lateral direction extending both the ends thereof from the front and back surfaces of the bracket 34. Coil springs 37 and 38 are coupled between both the ends of this pin 36*a* and both the ends of the pin 32*b* of the partition plate 14. The abut side 14*a* of the partition plate 14 is therefore pushed toward the pusher ring 17. The bracket 34 has recesses so that the motion of the pin 32*b* of the partition plate 14 is not constrained.

The bracket 34 is mounted on the bottom surface of the board 5*a* at the boundary between the play areas 11*a* to 11*d*, by a pair of mount surfaces 40*a* and 40*b* formed at the upper portion. Each partition plate 14 is inserted from the lower side into a slit 41 formed at the boundary between the play areas 11*a* to 11*d*, and the fan-shaped portion of the partition plate 14 protrudes above the play field 5. Each partition plate 14 is formed with a plurality of holes having a diameter smaller than the diameter of the medal 5 to thereby reduce its weight. Those holes are omitted from FIG. 1 for the purpose of simplification.

As shown in FIG. 3, the abut side 14*a* of the partition plate 14 is pushed by the circumferential surface and lower surface of the medal pusher 12. As the abut position changes, each partition plate 14 swings about the mount shaft 35. As the portion of the circumferential surface of the medal pusher 12 remotest from the rotary shaft 19*a* passes through each play area, the partition plate 14 is retracted most against the force of the coil springs 37 and 38, and moves under the play field 5 via the slit 41 formed in and through the board 5*a*. After this portion passes, the partition plate gradually swings and moves above the play field 5 by the recovery force of the coil springs 37 and 38.

As the portion of the circumferential surface of the medal pusher 12 nearest to the rotary shaft 19*a* passes near the abut side of the partition plate, the mount piece 32 of the partition plate abuts on the pin 36*b* as shown in FIG. 3, and the partition plate 14 protrudes most above the play field 5. In this case, although a small gap is formed between the partition plate 14 and the circumferential surface of the medal pusher 12, this gas is so small that the medal 4 cannot pass therethrough. As above, the partition plate 14 moves without constraining the eccentric rotation of the medal pusher 12, shields each play area from another play area, and prevents the medal from moving to a different play area.

Figure 5:
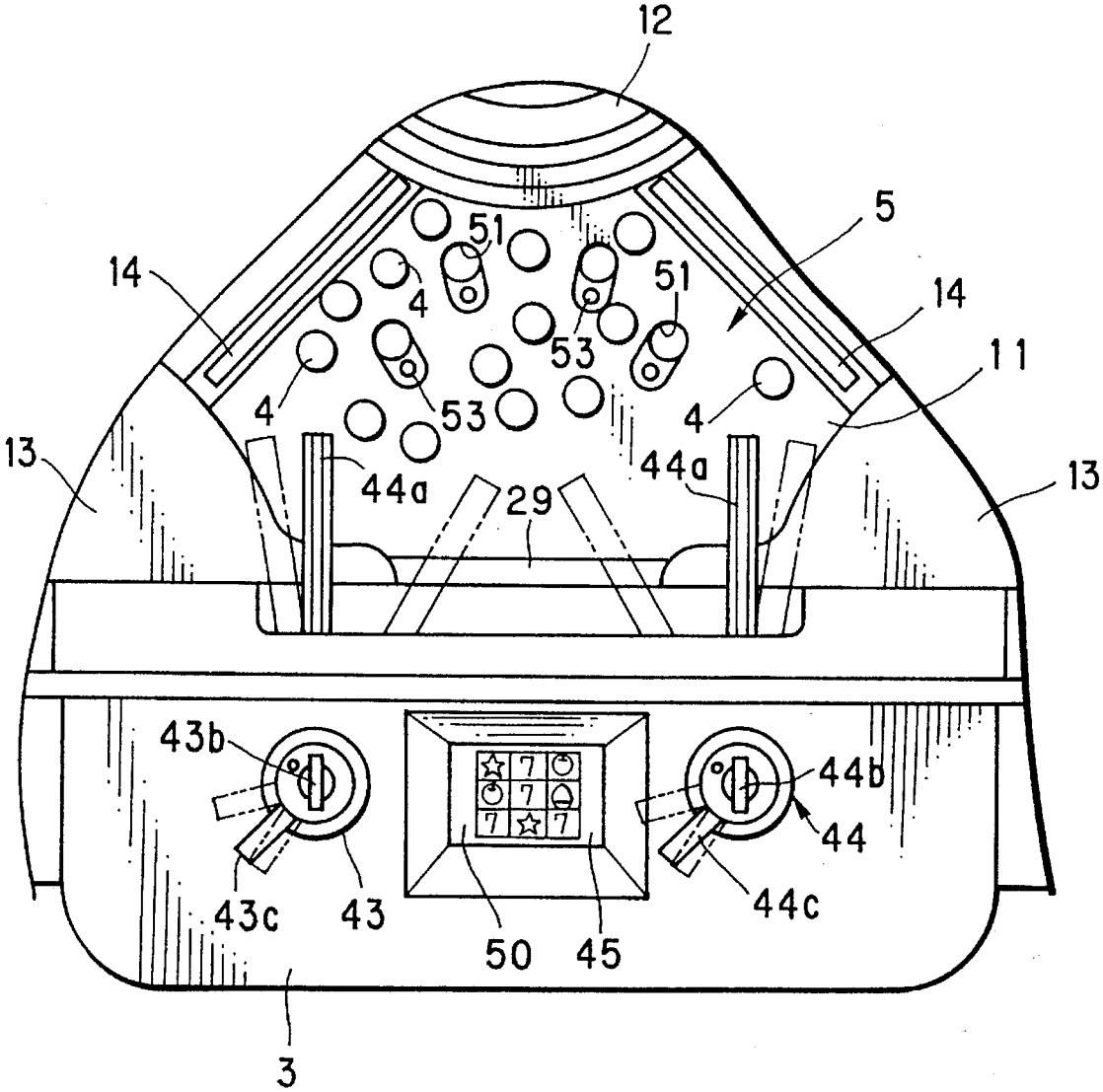
FIG. 5 is a partial plan view of an operation panel.

As shown in FIG. 5, each operation panel 3*a* to 3*d* is provided with two medal shooters 43 and 44 and a color liquid crystal display 45. The medal shooters 43 and 44 are rotatively mounted on the operation panel 3, and operation levers 43*c* and 44*c* for rotatively manipulating the medal shooters 43 and 44 are formed integral with the medal shooters 43 and 44. Medal shoots 43a and 44a are coupled to the medal shooters 43 and 44. With rotative manipulation of the medal shooters 43 and 44, the directions of these medal shoots 43*a* and 44*a* can be controlled within ranges indicated by two-dot chain lines in FIG. 5. The medal shoots 43*a* and 44*a* are of a spout shape and the medal 4 rolls along this spout. At the upper portion of each medal shooter 43 and 44, medal inlets 43*b* and 44*b* for inserting the medal 4 are formed. As compared to a pusher game machine of the type that a medal inlet is formed on the side wall of the machine, the embodiment medal shooters 43 and 44 allow a player to shorten a time during which the player does not observe the play field 5 and a proper timing of medal shooting can be correctly obtained.

Figure 6:
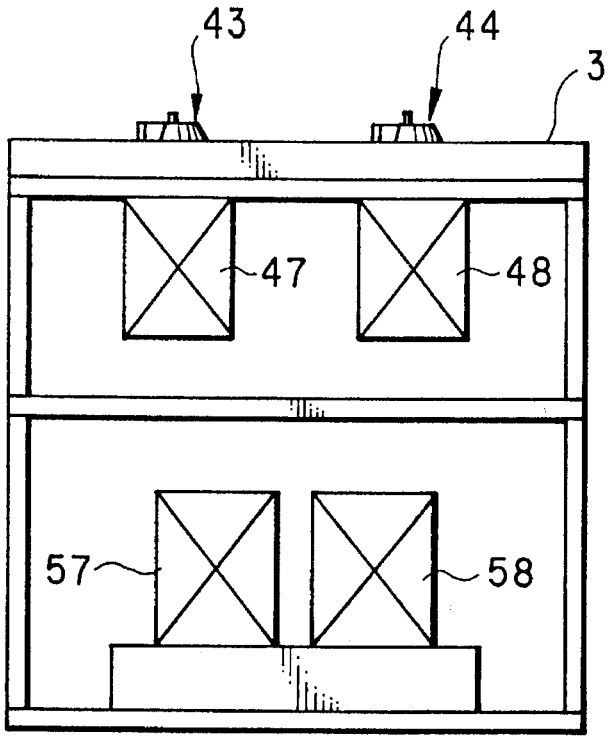
FIG. 6 is an illustrative diagram showing the assembly state of components under the operation panel.

As shown in FIG. 6, at the lower portion of the medal shooters 43 and 44, medal selectors 47 and 48 are mounted. The medal selectors 47 and 48 discriminate between proper and improper medals 4, and if proper they are supplied to the medal shoots 43*a* and 44*a*, whereas if improper, they are discharged to a reception saucer 30.

Each operation panel 3*a* to 3*d* is provided with the color liquid crystal display 45. This liquid crystal display 45 is used for slot machine game as an additional game. As the additional game starts, a moving reel screen 50 of slot machine game is displayed on the color liquid crystal display 45. A combination of symbols displayed when the moving reel screen is stopped, determines a hit or mishit of the additional game.

Figure 7:
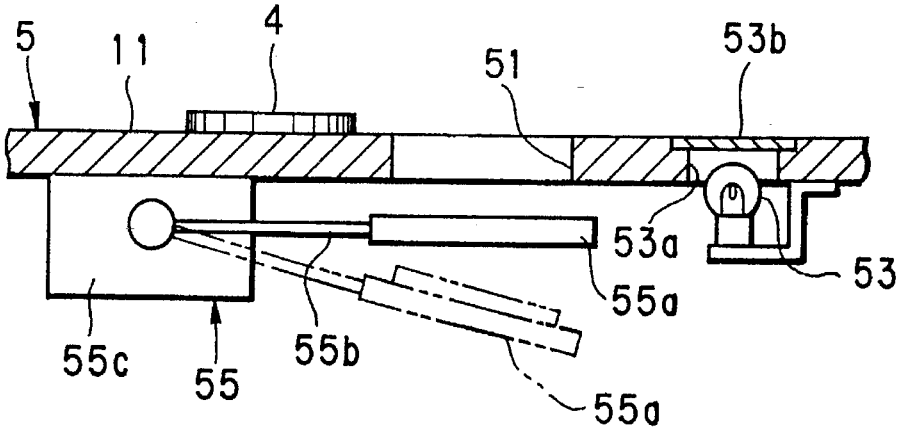
FIG. 7 is a partial cross sectional view showing the structure near a win hole formed at the play field.

As shown in FIG. 7, at the lower portion of each win hole 51, a medal sensor 55 for detecting a dropped medal 4 is disposed. This medal sensor 55 is constituted by a reception plate 55*a* for receiving a medal 4, an am unit 55*b* for supporting the plate 55*a*, and a switch 55*c*. When the reception plate 55*a* receives a medal 4, the weight of this medal 4 makes the arm unit 55*b* swing to the position indicated by two-dot chain lines in FIG. 7. This swing turns the switch 55*c* on and rolls down the medal 4 from the reception plate 55*a*. The dropped medal 4 enters a drop hopper 58 disposed at the lower portion of the medal selectors 47 and 48. After the medal 4 drops, the arm unit 55*a* recovers the initial position by a force of a spring (not shown).

The drop hopper 58 receives medals 4 falling in the win hole 51 and medals 4 falling in the trench 29. This drop hopper 58 is provided with a sensor for detecting a received medal 4, and pays out the medals to the reception saucer 30 as many as the detected numbers.

A display lamp 53 is disposed near each win hole 51. This display lamp 53 is disposed at the lower portion of a hole 53*a* formed in the board 5*a*. The hole 53*a* is covered with a transparent plastic plate 53*b*. The display lamp 53*a* is selectively flushed during a game, and if a medal 4 enters the win hole 51 with the flushed display lamp 53, a slot machine game is given as the additional game. If a hit is obtained during this slot machine game, a pay hopper 57 juxtaposed with the drop hopper 58 pays out the medals 4 to the reception saucer as many number as the type of hit.

Figure 8:
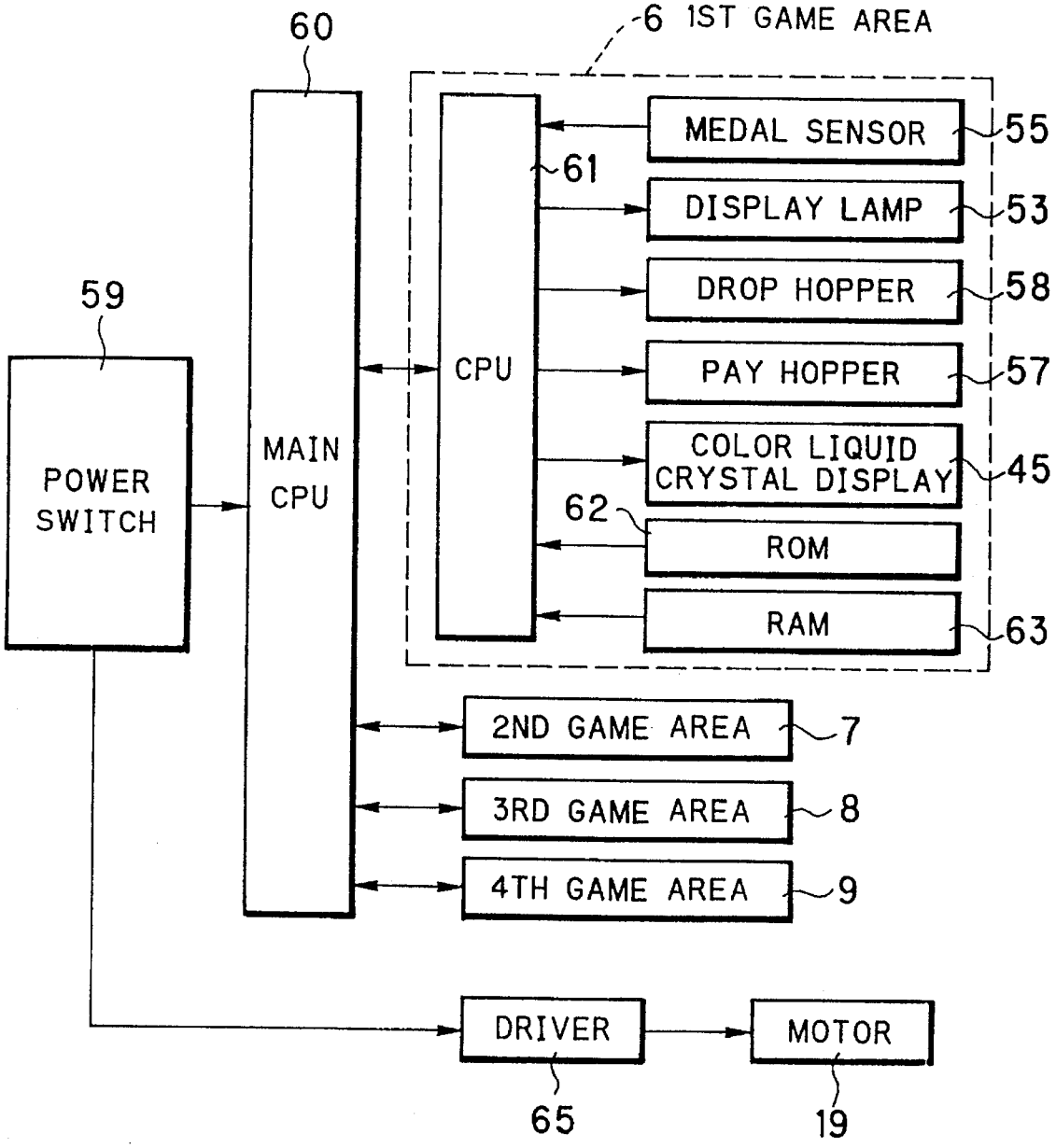
FIG. 8 is a block diagram showing the electrical structure of the medal pusher game machine shown in FIG. 1.

Next, with reference to FIG. 8, the electrical structure and operation of the pusher game machine will be described. A main CPU 60 controls the whole of the game machine 2. The electrical structure is divided into first to fourth game areas 6 to 9 corresponding to the operation panels 3i ato 3*d*. Each game area has the same electrical structure. Each game area is provided with a CPU 61. Under the total management by the main CPU 60, each CPU 61 performs an operation for each operation panel in accordance with a game program stored in a ROM 62. Data, flags, and the like collected during the execution of the game program are written in or read from a RAM 63 at proper timings.

As a power switch 59 of the game machine 2 is turned on, a power is supplied to a driver 65 and a motor 19 is driven. The rotary shaft 19*a* of the motor 19 rotates in the clockwise direction as viewed in FIG. 2, and the gear support plate 24 rotates in the same direction to make the medal pusher 12 eccentrically rotate in the clockwise direction around the rotary shaft 19a. The gear 22 meshing with the gear 21 rotates in the clockwise direction, and the gear 23 meshing with the gear 22 rotates in a counter-clockwise direction. The medal pusher 12 therefore rotates in the counter-clockwise direction about its rotation bearing shaft 25.

Each partition plate 14 disposed around the medal pusher 12 partitions between the circumferential surface of the medal pusher 12 and the step 13 to prevent the medal 4 from transferring between adjacent play areas. As the medal pusher 12 eccentrically rotates and moves, the abut side 14*a* of each partition plate 14 is pushed by the circumferential surface and lower surface of the medal pusher 12. The pushed partition plate 14 swings about the mount pin 35 against the force of the coil springs 37 and 38 and moves under the play field 5 to allow the rotation of the medal pusher 12. During this motion, the partition plate 14 gradually moves downward in association with the eccentric rotation of the medal pusher 12, so that the partition plate 14 reliably partitions between the circumferential surface of the medal pusher 12 and the step 13 even during this motion.

A player starts a game at an empty operation panel, e.g., the operation panel 3a. One of the medal shooters 43 is selected and the front end of the medal shoot 43*a* is targeted to a proper position where the medal 4 is to be thrown. As a medal 4 is inserted into the upper medal inlet 43*b*, the inserted medal 4 is sent to the medal selector 47, if the medal is proper, it is immediately dropped onto the play area 11*a* via the medal shoot 43*a*. If improper, the medal is discharged to the reception saucer 30.

If the medal 4 thrown onto the play area 11a is in the space between the circumferential surface of the medal pusher 12 and the medal pool field, this medal 4 is pushed by the circumferential surface of the rotating medal pusher 12 and collides with another medal already placed on the play field 11*a*. Depending upon the positions of placed medals 4 and an eccentric motion of the medal pusher 11a about the rotary shaft and about its own rotation bearing shaft, the directions of motion of the medal 4 change irregularly. Therefore, as compared to a conventional pusher game machine with a linear motion of a medal pusher, interest on the game can be further enhanced.

Some medal 4 may roll on the play area 11*a* and move toward an adjacent play area depending upon the fall state of the medal 4. In this case, however, since the partition plate 14 upright on the play field 5 always partitions the play area 11*a*, the medal 4 will not enter the adjacent play area and will not be missed, or conversely, a medal 4 will not enter from the adjacent play area and will not hinder the play. As a medal 4 drops into the trench 29 by the pushing operation of the medal pusher 12, it is received by the drop hopper 58. The drop hopper 58 pays out the medals same in number as the dropped medals to the reception saucer 30 to thereafter complete one game.

During the game, if a medal 4 enters the win hole 51 with the flushed display lamp 53, an on-signal from the medal sensor 55 is supplied to CPU 61 as a start signal for the additional game. If a medal 4 enters the win hole 51 without the flushed display lamp 53, the on-signal from this switch 55 does not permit the additional game because the flushing display of the display lamp 53 is controlled by CPU 61.

When the additional game starts, a moving reel screen of a slot machine is displayed on the color liquid crystal display 45. When the moving reel screen display is stopped after a random time lapse and if CPU 61 judges the combination of symbols to be a hit, CPU 61 activates the pay hopper 57 to pay the medals corresponding in number to the type of hit to the reception saucer 30. The medal 4 dropped into the win hole 51 enters the drop hopper 58 which pays out the same number of dropped medals to the reception saucer 30.

CPU 61 changes the flushing display of the display lamp 53 at random timings to thereby change the position of the win hole 51 for starting the additional game. CPU 61 supplies game data for each operation panel to the main CPU 60, the game data including the number of medals dropped into the trench 29, the number of medals paid out by the additional game. The main CPU 60 collects and manages the game data supplied from CPU 61 at each operation panel. For example, the main CPU 60 can control the time period of the flushing display of the display lamp 53, the win occurrence rate during the additional game, and the like, while considering the game results at each play area.

In embodying the present invention, the number of play areas partitioned around the medal pusher is not limited to four. Two, three, or five or more play areas may be used. The number of win holes provided for the additional game is not limited to four. The type of the additional game may be not only a slot machine game but also other games such as a bingo game. Still further, the rotation direction of the medal pusher may be changed as desired. For example, one rotation about its own rotation shaft may be performed during one eccentric rotation, and the speed and direction of rotation may be changed at a suitable period.

In the above embodiment, the medal pusher 12 is circular in plan view so that the eccentric rotation is performed. If the medal pusher 12 is ellipsoidal, polygonal, or other shapes in plan view, a similar medal pusher game can be played without the eccentric rotation of the medal pusher. The partition plate may be adapted to slide in parallel with the play field so that it moves toward the outside of the play field when it is pushed by the medal pusher. Furthermore, the medal pusher may be formed with a cam surface at the portion lower than the play field so that it is moved by this cam surface. The invention can be embodied to various other modifications without departing from the scope of appended claims.

I claim:

1. A medal pusher game machine wherein a medal pusher is rotated on a horizontal play field and a circumferential surface of said medal pusher pushes a medal entered by a player toward the final edge of the play field to drop each medal placed on the play field away from the final edge of the play field, said medal pusher game machine comprising:

a plurality of partition plates disposed radially relative to the play field and projecting above the play field, for partitioning the play field into a plurality of play areas around the medal pusher; and a partition plate moving mechanism for allowing said partition plates to move in accordance with rotation of said medal pusher, to avoid hindering the rotation of the medal pusher.

2. A medal pusher game machine according to claim 1, wherein said partition plate moving mechanism includes a swing shaft for supporting said partition plate and allowing said partition plate to swing through a slit formed through a board defining the play field, and a spring for biasing one end of said partition plate in the direction of abutting the one end on the circumferential surface of the medal pusher, and wherein said partition plate swings to partially move under the play field via the slit when the one end of said partition plate is pushed by the circumferential surface of the medal pusher.

3. A medal pusher game machine according to claim 2, wherein said swing shaft bears one other end of said partition plate under the play field, and said partition plate swings to move under the play field by advancing the one other end of said partition plate downwards via the slit when the one end of said partition plate is pushed by the circumferential surface of the medal pusher.

4. A medal pusher game machine according to claim 2, wherein said partition plate is formed with a number of holes having a diameter smaller than the diameter of the medal.

5. A medal pusher game machine according to claim 1, wherein the medal pusher is cylindrical, and said circumferential surface is substantially vertical to said play field.

6. A medal pusher game machine according to claim 5, wherein said medal pusher revolves in planetary fashion about a vertical shaft.

7. A medal pusher game machine according to claim 6, further comprising:

a motor;

a sun gear secured to a shaft of said motor;

a first planet gear, meshed with said sun gear, for rotating about a center thereof, and for revolving about said sun gear;

a second planet gear, meshed with said first planet gear, for rotating about a center thereof, and for revolving about said sun gear with said first planet gear; and a support shaft having one end where said second planet gear is secured, and another end where said medal pusher is secured.

8. A medal pusher game machine according to claim 1, further comprising an operation panel laid in parallel with the play field and provided for each of said play areas, and a medal shooter provided on the upper surface of each of said operation panel for shooting a medal entered from the upper portion of said medal shooter toward a corresponding play area.

9. A medal pusher game machine according to claim 8, further comprising a win hole formed at each play area for receiving fall of the medal, wherein when the medal falls in said win hole, an additional game screen is displayed on a display device assembled with said operation panel.

10. A medal pusher game machine according to claim 9, wherein said additional game is a slot machine game which is performed under the control of a CPU provided for each of said operation panels.

11. A medal pusher game machine according to claim 1, wherein said partition plate moving mechanism allows said partition plates to move substantially vertically to said play field.

* * * * *